United States Patent [19]

Couper

[11] Patent Number: 4,921,664

[45] Date of Patent: May 1, 1990

[54] METHOD FOR PRODUCING A HEAT-RESISTANT ALUMINUM-ALLOY WORKPIECE HAVING HIGH TRANSVERSE DUCTILITY WHICH IS MANUFACTURED FROM A COMPACT PRODUCED BY POWDER METALLURGY

[75] Inventor: Malcolm Couper, Siggenthal-Station, Switzerland

[73] Assignee: Asea Brown Boveri Ltd., Baden, Switzerland

[21] Appl. No.: 307,496

[22] Filed: Feb. 8, 1989

[30] Foreign Application Priority Data

Feb. 8, 1988 [CH] Switzerland ..... 429/88

[51] Int. Cl.[5] ..... B22F 1/00

[52] U.S. Cl. ..... 419/1; 419/23; 419/39; 419/42; 419/48; 419/67; 419/68

[58] Field of Search ..... 75/249, 232; 419/23, 419/42, 48, 67, 68

[56] References Cited

U.S. PATENT DOCUMENTS 4,435,213 3/1984 Hideman et al. ..... 75/249
4,702,885 10/1987 Odani et al. ..... 419/23
4,722,751 2/1988 Akechi et al. ..... 75/232

FOREIGN PATENT DOCUMENTS 0019569 11/1980 European Pat. Off. .
0022688 1/1981 European Pat. Off. .
0133144 2/1985 European Pat. Off. .

OTHER PUBLICATIONS

Metallurgical Dictionary, Henderson, J. G., Reinhold Publishing, 1953.

*Primary Examiner*—Stephen J. Lechert, Jr.
*Assistant Examiner*—Nina Bhat
*Attorney, Agent, or Firm*—Oblon, Spivak, McClelland, Maier & Neustadt

[57] ABSTRACT

Method for producing a heat-resistant aluminum-alloy workpiece having high transverse ductility which is manufactured from a compact produced by powder metallurgy, in which alloy powders are first cold-isostatically pressed under a pressure of 1500 to 5000 bar and the extrusion billet (2) produced in this manner is hot-recompacted and extruded to form a bar (7) with rectangular cross-section. Reduction ratio at least 6:1. A prismatic bar section (8) is separated from the bar (7) and is converted without further hot deformation and solely by machining into the final product in a manner such that the mechanical main load directions of the final product position themselves in a plane which is parallel to the plane which is extended through the extrusion direction and the longitudinal axis of the cross-section of the bar (7).

8 Claims, 3 Drawing Sheets

METHOD FOR PRODUCING A HEAT-RESISTANT ALUMINUM-ALLOY WORKPIECE HAVING HIGH TRANSVERSE DUCTILITY WHICH IS MANUFACTURED FROM A COMPACT PRODUCED BY POWDER METALLURGY

BACKGROUND OF THE INVENTION

1. Field of the Invention

Bodies of heat-resistant aluminum alloys which are produced from powders with high cooling rate obtained by atomizing a melt. High content of alloy constituents which are not permissible under otherwise standard solidification conditions such as, for example Fe, Cr and V.

The invention relates to the production of moldings with improved mechanical properties starting from aluminum alloys.

In particular, it relates to a method for producing a heat-resistant aluminum-alloy workpiece having high transverse ductility which is manufactured from a compact produced by powder metallurgy, in which alloy powder of the final composition or a mixture of prealloy powders is first cold-isostatically pressed under a pressure of 1500 to 5000 bar and the extrusion billet produced in this manner is recompacted in the chamber of an extrusion press by hot pressing and is extruded immediately afterwards to form a compact, and piece is cut off the compact for further shaping.

2. Discussion of Background

The following literature is cited in relation to the prior art: "High-strength powder metallurgy aluminium alloys", edited by M. J. Koczak and G. J. Hildeman, TMS-AIME, 1982, pages 63–86: M. Rafalin, A. Lawley and M. J. Koczak, "Fatigue of high-strength powder metallurgy aluminium alloys".

In the document mentioned attention should be paid, in particular, to FIG. 1.

The production of workpieces-powder metallurgy manufacture is normally carried out by upsetting a compact or a bar section in the direction of the main axis (usually the axis of rotation) and subsequent forging. Compare also FIGS. 1 to 4 in this document.

FIG. 1 shows a perspective representation of a compacting process. The aluminum-alloy powder is compacted in a press to form a compact body 1. The externally applied compressive forces are indicated by arrows. Usually such bodies 1 are produced by hot pressing and have, as a rule, a cylindrical shape. A first step in the method may, however, also be cold pressing or cold isostatic compacting (not shown).

FIG. 2 relates to a perspective representation of an extrusion process. The compressive forces acting from the outside are again indicated by arrows which coincide with the extrusion direction and the longitudinal axis of the body. 2 is the already partially extruded extrusion billet having the normal cylindrical shape. 3 is the extruded bar resulting therefrom and having, as a rule, a circular cross-section. 4 represents a cylindrical bar section.

FIG. 3 shows a perspective representation of an upsetting process. The elongated cylindrical bar section 4 shown by broken lines is deformed by axial compressive forces (indicated by arrows) to form a forged cylindrical blank 5 in the form of a flat disk.

FIG. 4 relates to a perspective representation of a forging process. The blank 5 (FIG. 3) which is not shown is deformed by further steps in the method (compressive forces indicated by broken arrows) to form a die-forged finished body of revolution 6.

In this technique, the deformation takes place in all the steps in the method virtually uniaxially, i.e. in the direction of the original compressive forces in the first compacting (FIG. 1) or in the extrusion direction (FIG. 2). This has the result that the finished workpiece is strongly anisotropic and has strongly varying mechanical properties in the various directions. Highly heat-resistant alloys produced by powder metallurgy are, as a rule, difficult to deform. Owing to their low ductility at the comparatively low forging temperature, the mold filling capacity is poor and the crack susceptibility is high. If the extrusion process step is dispensed with, the deformation is inadequate. The ductility is very low in all directions. Although the ductility in the longitudinal direction (extrusion direction) meets the requirements if the extrusion step is introduced, it is very low at right angles to the extrusion direction. However, in bodies of revolution, the main load in operation is precisely in the plane which is perpendicular to the extrusion and upsetting direction. In addition, the ductility varies considerably from the core to the edge. The body behaves anisotropically, and this prevents its maximum exploitation in operation. Two examples may demonstrate this:

Example A based on the prior art:

The raw material used was powder obtained by atomization of an alloy of the following composition having a particle size of up to 70 μm:

Fe=8% by weight
Zr=2% by weight
Al=remainder.

The powder was poured into an aluminum capsule, degassed under vacuum by heating and compacted in a mold by uniaxial hot pressing. The aluminum capsule was removed mechanically and the workpiece was forged by upsetting in a die to a flat pancake-like disk of 120 mm diameter and 50 mm height.

Test pieces were cut out of the disk and subjected to mechanical test at room temperature.

The tensile test yielded the following results:

| | |
|---|---|
| Yield point in all three directions: | 425 MPa |
| Axial elongation, core (center): | 0% |
| Axial elongation, core (circumference): | 2.5% |
| Radial elongation, core: | 1% |
| Radial elongation, edge: | 4% |
| Tangential elongation, core: | 2.5% |
| Tangential elongation, edge: | 5% |

The elongation values in the core are inadequate in all three directions and this is all the more serious since the center of a body of revolution is known to have the highest load during rotary movement while in operation.

Example B based on the prior art:

The raw material used was powder obtained by atomization of an alloy of the following composition having a particle size of up to 70 μm:

Fe=8% by weight,
Zr=2% by weight,
Mo=1% by weight,
Al=remainder.

As in Example A, the powder was poured into an aluminum capsule and hot-pressed under vacuum. The workpiece was employed as extrusion billet in an extrusion press and extruded to form a bar with a reduction ratio of 10:1. A bar section was forged in a die to form a pancake-like disk of 100 mm diameter and 45 mm height.

The tensile specimens cut out of the disk yielded the following values at room temperature:

| | |
|---|---|
| Yield point in all three directions: | 410 MPa |
| Axial elongation, core: | 1% |
| Axial elongation, edge: | 4% |
| Radial elongation, core: | 1.5% |
| Radial elongation, edge: | 6% |
| Tangential elongation, core: | 2% |
| Tangential elongation, edge: | 8% |

The elongation values in the core are still poor in all three directions. It is only at the edge that the ductility meets the requirements.

SUMMARY OF THE INVENTION

Accordingly, one object of this invention is to provide a novel method for producing a heat-resistant aluminum-alloy workpiece of powder metallurgy manufacture, the workpiece being intended to have a high transverse ductility and as uniform strength properties as possible in all three main directions. At the same time, the ductility, measured as elongation in the tensile test, in the main stress plane (plane of the main load directions in operation) is required to be at least 5%. The method should, if possible, manage without the difficult forging operations which are critical in relation to the crack susceptibility of the material.

This object is achieved by the method mentioned in the introduction, which comprises, extruding, as compact, a bar having rectangular cross-section while maintaining a reduction ratio of at least 6:1, from which bar a disk-shaped prismatic bar section is converted without further hot deformation and solely by machining into the final product, attention being paid to the fact that the mechanical main load directions of the final product position themselves in a plane which is parallel to the plane which is extended through the extrusion direction and the longitudinal axis of the cross-section of the bar.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
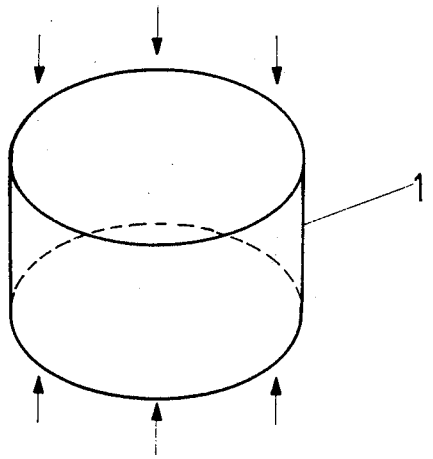
FIG. 1 shows a perspective representation of a compacting process.
Figure 2:
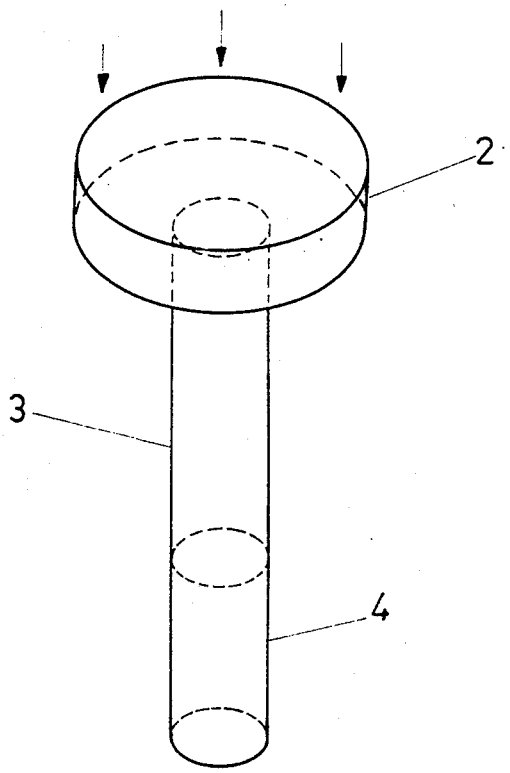
FIG. 2 shows a perspective representation of an extrusion process.
Figure 3:
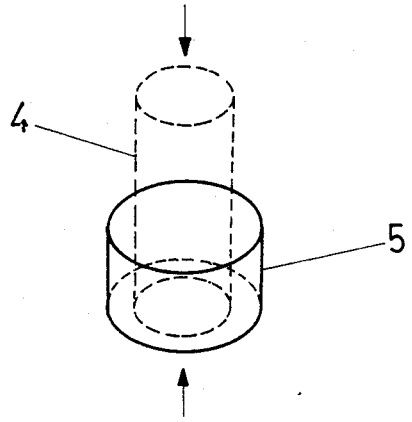
FIG. 3 shows a perspective representation of an upsetting process.
Figure 4:
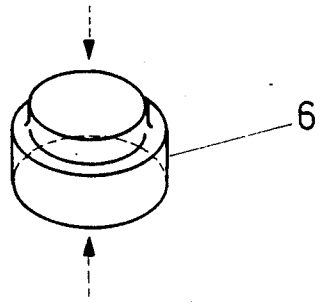
FIG. 4 shows a perspective representation of a forging
Figure 5:
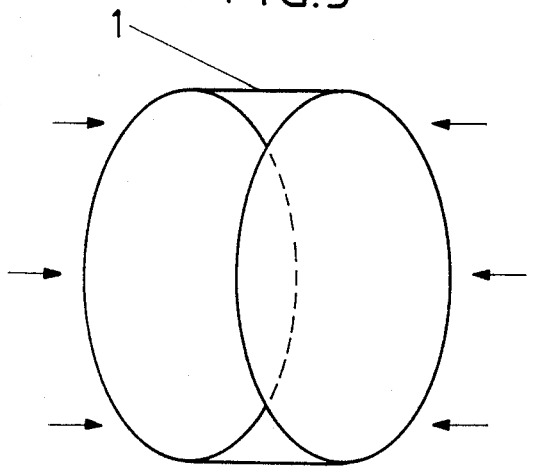
FIG. 5 shows a perspective representation of a compacting process.

Referring now to the drawings, wherein like reference numerals designate identical or corresponding parts throughout the several views, FIG. 5 shows a perspective representation of a compacting process. The aluminum-alloy powder is first cold-compacted and/or hot-compacted in a press to form a compact body 1. The compressive forces are indicated by arrows. The compacting is carried out, as a rule, under vacuum and usually in a thin-walled aluminum capsule as sheathing.

Figure 6:
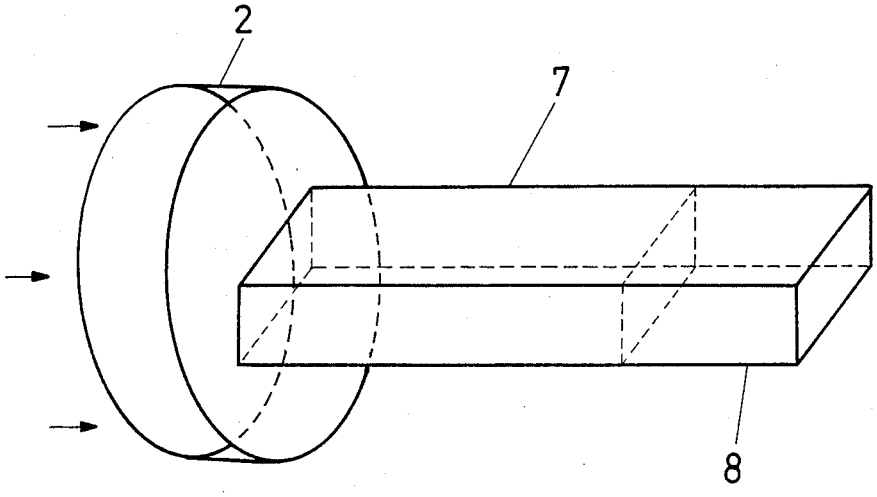
FIG. 6 shows a perspective representation of an extrusion process.

FIG. 6 relates to a perspective representation of an extrusion process. The compressive forces are indicated by arrows. Their direction coincides with the longitudinal axis of the bar and of the extrusion direction. The extrusion billet 2 is already partly extruded. 7 is the extruded bar having rectangular cross-section, and 8 is a prismatic bar section of the bar 7.

Figure 7:
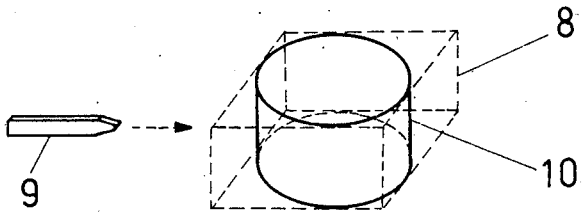
FIG. 7 shows a perspective representation of a mechanical coarse machining operation (roughturning)

FIG. 7 shows a perspective representation of a mechanical coarse machining operation (roughturning). The prismatic bar section 8 is indicated by broken lines. The bar section 8 is subjected to a first shaping step (represented by turning) with the mechanical machining tool 9. Here the machining operation is carried out so that the axis is perpendicular to the extrusion direction during the turning operation: radial plane parallel to the main symmetry plane (plane of the largest face of the prism) of the bar section 8. In this way, a mechanically machined cylindrical blank 10 is first produced.

Figure 8:
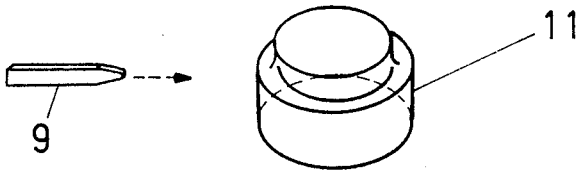
FIG. 8 shows a perspective representation of a mechanical fine machining operation (smoothing).

FIG. 8 shows a perspective representation of a mechanical fine machining operation (smoothing). The mechanical machining tool 9 (in the present case a turning tool) give the blank (10 in FIG. 7) the final shape. 11 is the finished shouldered body of revolution produced by mechanical machining (smoothing).

Exemplary embodiment 1:

See FIGS. 5 to 8

A rotationally symmetrical workpiece for a compactor was produced from a heat-resistant aluminum alloy. The aluminum alloy had the following composition:

Fe=8% by weight
Zr=1% by weight
Al=remainder

The alloy was fused and atomized to form a powder with a particle size of 5 to 70 μm. The powder was poured into a rubber hose, degassed and isostatically compacted under a pressure of 3000 bar. The cold-compacted compact 1 had a diameter of 380 mm and a height of 500 mm. It was hot-recompacted under a pressure of 4000 bar and then used as extrusion billet 2. An extruded bar 7 was produced having rectangular cross-section (width=160 mm; height=80 mm). The reduction ratio was approx. 9:1. A prismatic bar section 8 with a length of 160 mm was cut out of the bar 7. From this, a cylindrical blank 10 was first produced by roughturning using the mechanical machining tool 9 and then a finished shouldered body of revolution 11 was produced by smoothing. The following mechanical values determined on tensile specimens at room temperature were found:

| | |
|---|---|
| Yield point in all three directions: | 415 MPa |
| Axial elongation (perpendicular to the extrusion direction and perpendicular to the main plane of | 3% |

-continued

| | |
|---|---|
| the bar): | |
| radial elongation (perpendicular to the extrusion direction and in the main plane of the bar): | 6% |
| Radial elongation (parallel to the extrusion direction): | 8% |
| Tangential elongation (parallel to the extrusion direction): | 8% |
| Tangential elongation (perpendicular to the extrusion direction and in the main plane of the bar): | 6% |

No difference could be found in the ductility between core and edge of the body of revolution 11. The ductility values of the core, which are critical for operation, consequently vary in the range from 6 to 8% for the radial and for the tangential direction.

Exemplary embodiment 2:

See FIGS. 5 to 8

A rotationally symmetrical workpiece for a heat engine was manufactured from a heat-resistant aluminum alloy. The aluminum alloy had the following composition:

Fe=10% by weight

Mo=2% by weight

Al=remainder

The alloy was fused and atomized to form a powder having a particle size of 4 to 65 μm. The powder was poured into a thin-walled soft-aluminum capsule of 275 mm diameter and 300 mm height and hot-compacted to form a compact 1 by uniaxial pressure without degassing. The aluminum capsule was then removed mechanically by turning and the body was employed as extrusion billet 2 in an extrusion press with a chamber diameter of 280 mm and extruded to form a bar 7 of rectangular cross-section (width=120 mm; height=50 mm). The reduction ratio was 10:1. A prismatic bar section 8 with a length of 120 mm was cut out of the bar 7, and a blank 10, and finally a finished body of revolution 11, were produced therefrom as in Example 1. The tensile tests carried out at room temperature yielded the following picture:

| | |
|---|---|
| Yield point in all three directions: | 420 MPa |
| Tensile strength in all three directions: | 470 MPa |
| Elongation perpendicular to the extrusion direction and perpendicular to the main plane of the bar: | 3% |
| Elongation perpendicular to the extrusion direction and in the main plane of the bar: | 9% |
| Elongation parallel to the extrusion direction: | 15% |

The ductility was virtually equally large in the core and in the edge region of the workpiece. The ductility values in the main plane (radial plane) of the body of revolution 11, which are critical for operation, consequently fell within the range from 9 to 15% and may be classified as excellent for such materials.

The invention is not limited to the exemplary embodiments. In principle any heat-resistant aluminum alloy produced by powder metallurgy can be used.

Allow powders of the final composition or a mixture of prealloy powders are first cold-isostatically pressed under a pressure of 1500 to 5000 bar and the extrusion billet (2) produced in this manner is recompacted in the chamber of an extrusion press by hot pressing and then extruded to form a compact. A piece is then cut from the compact for further shaping. A bar (7) having a rectangular cross-section is pressed as compact while maintaining a reduction ratio of at least 6:1, from which bar a disk-shaped prismatic bar section (8) is separated and is converted without further hot deformation and solely by mechanical working into the final product. Attention is paid to the act that the mechanical main load directions of the final product position themselves in a plane which is parallel to the plane which is extended through the extrusion direction and the longitudinal axis of the cross-section of the bar (7).

The advantage of the method lies, in particular, in an appreciable increase of the ductility in the plane in which the main load occurs in operation.

Obviously, numerous modifications and variations of the present invention are possible in the light of the above teachings. It is therefore to be understood that within the scope of the appended claim, the invention may be practiced otherwise than as specifically described herein.

What is claimed is:

1. A method for producing a heat-resistant aluminum alloy workpiece having high transverse ductility, comprising the steps of:

(a) compacting by means of compressive force an aluminum alloy powder having the final composition of said workpiece or a mixture of prealloy powders, by cold-isostatically pressing, hot-pressing or a combination of cold-isostatically pressing and hot-pressing said powder or powders to produce an extrusion billet, (b) extruding said billet to form a compact bar having a rectangular cross-section, by applying compressive force to said billet in a direction parallel to the longitudinal axis of said bar and parallel to the direction of compressive force in said compacting step, (c) separating from said bar a disk-shaped prismatic bar section, and (d) machining said prismatic bar section to obtain said workpiece.

2. The method of claim 1, wherein said cold-isostatic pressing is performed under a pressure of 1500 to 5000 bar.

3. The method of claim 1, wherein a reduction ratio of at least 6:1 is maintained during said extruding step.

4. The method of claim 1, wherein said prismatic bar section is machined without further hot deformation.

5. The method of claim 1, wherein said machining step comprises a coarse machining step and a subsequent fine machining step.

6. The method of claim 1, wherein said compacting step is conducted under a vacuum.

7. The method of claim 1, wherein the ductility, measured as elongation in the tensile test, in a plane parallel to the direction of said compressive force in step (1) and the direction of said compressive force in step (2) is at least 5%.

8. The method of claim 1, wherein said compacting step comprises cold-isostatically pressing said powder or powders followed by recompacting by hot-pressing to form said extrusion billet.

* * * * *